US009086226B2

(12) United States Patent
Bauer

(10) Patent No.: US 9,086,226 B2
(45) Date of Patent: Jul. 21, 2015

(54) CONTROL DEVICE FOR VENTILATION AND AIR CONDITIONING SYSTEMS

(75) Inventor: Albert Bauer, Munich (DE)

(73) Assignee: ROBERT BOSCH GMBH, Stuttgart (DE)

( * ) Notice: Subject to any disclaimer, the term of this patent is extended or adjusted under 35 U.S.C. 154(b) by 786 days.

(21) Appl. No.: 13/128,227

(22) PCT Filed: Nov. 17, 2009

(86) PCT No.: PCT/EP2009/008178

§ 371 (c)(1),
(2), (4) Date: May 31, 2011

(87) PCT Pub. No.: WO2010/054851

PCT Pub. Date: May 20, 2010

(65) Prior Publication Data

US 2011/0300790 A1 Dec. 8, 2011

(30) Foreign Application Priority Data

Nov. 17, 2008 (DE) ..... 10 2008 057 787

(51) Int. Cl.
*F24F 11/00* (2006.01)
*F24F 7/00* (2006.01)

(52) U.S. Cl.
CPC ..... *F24F 11/0076* (2013.01); *F24F 2011/0004* (2013.01); *F24F 2011/0005* (2013.01); *F24F 2011/0042* (2013.01)

(58) Field of Classification Search
USPC ..... 454/239
See application file for complete search history.

(56) References Cited

U.S. PATENT DOCUMENTS

| | | | |
|---|---|---|---|
| 2,038,579 | A | 4/1936 | Lamb |
| 2,613,919 | A | 10/1952 | Russell et al. |
| 2,753,157 | A | 7/1956 | Hoyer |
| 5,407,002 | A | 4/1995 | Voll |

(Continued)

FOREIGN PATENT DOCUMENTS

| | | |
|---|---|---|
| DE | 19654542 | 7/1998 |
| DE | 19654542 C2 | 8/2000 |

(Continued)

OTHER PUBLICATIONS

English translation of Abstract JP 2001-317772A.*

(Continued)

*Primary Examiner* — Steven B McAllister
*Assistant Examiner* — Helena Kosanovic
(74) *Attorney, Agent, or Firm* — Woodling, Krost and Rust

(57) ABSTRACT

The invention relates to a control device for room air managing systems, comprising at least one or more rooms (32, 34) or room zones; an inlet air channel (22) and room inlet air channels (22*a*) branching therefrom; an exhaust air channel (20) and room exhaust air channels (20 *a*) branching therefrom; an inlet ventilator (16) in the inlet air channel (22); controllable inlet air throttle flaps (14) for the inlet air flow in the room inlet air channel (20*a*); and, controllable exhaust air throttle flaps (12) for the exhaust air flow in the room exhaust air channel (22*a*). According to the invention, there is provided a pressure sensor (38) that detects the room pressure in the room (32, 34) that is to be air conditioned, wherein the room pressure constitutes the direct control parameter for the opening position of the inlet air throttle flap (14) and/or the exhaust air throttle flap (12).

19 Claims, 2 Drawing Sheets

(56) References Cited

U.S. PATENT DOCUMENTS

| | | | | |
|---|---|---|---|---|
| 5,720,658 | A | 2/1998 | Belusa | |
| 6,688,384 | B2 | 2/2004 | Eoga | |
| 8,348,732 | B2 * | 1/2013 | Aronstam et al. | 454/256 |
| 2003/0146289 | A1 | 8/2003 | Sekhar et al. | |
| 2009/0030555 | A1 | 1/2009 | Gray | |
| 2010/0320277 | A1 | 12/2010 | Stark | |

FOREIGN PATENT DOCUMENTS

| | | | |
|---|---|---|---|
| DE | 102005020934 | | 1/2006 |
| DE | 102005020934 | A1 | 1/2006 |
| EP | 0821204 | A1 | 1/1998 |
| EP | 0821204 | | 6/2003 |
| EP | 1538399 | A2 | 6/2005 |
| EP | 1538399 | | 4/2009 |
| JP | 2001317772 | | 11/2001 |
| JP | 2001317772 | A * | 11/2001 |
| WO | 2007062843 | | 6/2007 |
| WO | 2007062843 | A1 | 6/2007 |

OTHER PUBLICATIONS

Pocket book "Heizung und Klimatechnik", Document "Airflowcontrol", Recknagel, Sprenger, Schramek, Edition 67, Oldenburg Verlag Miinchen Wien, pp. 1043 and 1044.

Airflowcontrol, Planungshanbuch, Systemkomponenten zur Luftverteilung, Trox Technik, the art of handling air, pp. 11-12, Mar. 2007.

PCT/EP2009/008178, International Search Report, Mar. 9, 2010, European Patent Office.

International Preliminary Report on Patentability From the International Searching Authority, Dated May 26, 2011, Including Written Opinion in German (pp. 1 to 7) and an English Translation (pp. 8-14) Thereof; PCT/EP2009/008178; International Filing Date, Nov. 17, 2009; Applicant Bauer, Albert.

* cited by examiner

CONTROL DEVICE FOR VENTILATION AND AIR CONDITIONING SYSTEMS

This application claims the benefit of PCT/EP2009/008178, international application filing date Nov. 17, 2009, which claims the benefit and priority of and to German patent application no. DE 10 2008 057 787.1, filed Nov. 17, 2008.

The invention relates to a control device for ventilation and air conditioning systems.

For increasing comfort and for improving the room climate, nowadays air conditioning systems are used to a large extent. For example, DE 19654542 C2 discloses an energy saving air conditioning device. It comprises a central inlet air channel as well as a central exhaust air channel from which the respective channels for the supply of the rooms and the room zones, respectively, are branching off. The inlet air stream and the exhaust air stream are adjusted for balanced air usage. This is controlled depending on the climate parameters like temperature, air moisture and oxygen content. An inlet air ventilator provides, independent from the difference of the actual and the desired temperature of the room, the corresponding pressure for supplying the rooms with air. The supply is effected by means of a volume stream which can be adjusted according to requirements. As is told by this citation, the throttle flaps for the inlet air are controlled depending on the temperature. The throttle flaps for the exhaust air are coupled to the throttle flaps for the input air or they are independent therefrom. The citation does not discuss in more detail the case where the exhaust flap is independent from the control value of the input air flap or from this one directly.

The pocket book "Heating and Air Conditioning Technology", Recknagel, Sprenger, Schramek, Edition 67, Oldenburg Verlag Miinchen Wien, page 1043, page 1044 teaches that the control of the air quantities can be realized by means of the usage of volume stream controllers. The control of the input air as well as of the exhaust air is, therefore, effected by means of volume stream controllers. They control the opening cross section of their throttle flaps independently from the adjusted desired stream and influence in this way the amount of air flowing through. They are applied at the outlets of the input air channel as well as at those of the exhaust air channel in analogy to the teaching of DE 196 54 542 C2. The volume streams of the exhaust air as well as the input air minus the leakage have the deficiency that they comprise, depending on the number of the rooms or room zones to be air conditioned a large number of volume stream controllers.

Furthermore, from the citation "AIIRFLOWCONTROL, Design Handbook, system components for distributing air, page 11-page 12, of the company TROX Technik, room pressure controllers are known which are used in particular in such cases where a room is to be supplied with an over pressure or under pressure. In case of the room pressure control, the control value pressure influences the input air as well as the output air control indirectly. Therein, a volume stream is determined which is required for adjusting the pressure. This volume stream is then adjusted by a volume stream controller. This indirect control has the disadvantage that the integration of a volume stream controller is required because of the changes in the control variable. This is very cost and maintenance intensive.

It is the object of the present invention to provide a control device for a room air managing system which allows a cost efficient and flexible air stream control for achieving optimal air conditioning of a room.

The invention is based on the finding that cost intensive volume stream controllers can be replaced by an artful cooperation of the input air and output air control with components which are popular and cost effective and often already used.

The device comprises a room air managing system which comprises at least an inlet air channel and at least an exhaust air channel. From these central channels, further channels, room inlet air channels or room exhaust air channels, branch off into different rooms or room zones to be air conditioned.

The air input is ensured by means of an input air ventilator. Within the respective input air and exhaust air inlets and outlets, there are controllable throttle flaps which are adapted to be changed with respect to their opening cross section. According to the invention, the room pressure provides a direct control variable for the opening cross section of the respective input air throttle flap and/or exhaust air throttle flaps of a room. Therein, the room pressure is detected by means of a room pressure sensor located in the room to be air conditioned. In case the actual value of the room pressure is below the desired value, for example the opening cross section of the inlet air throttle flaps is enlarged and/or the opening cross section of the exhaust throttle flaps is diminished.

This embodiment is particularly advantageous since by means of the room pressure as a direct control variable, the design of the system is remarkably simplified. In conventional systems, the control variable room pressure is converted by calculation into a control variable volume stream. Therein, sensor means are required for determining a first control variable, the room pressure, as well as for controlling the second control variable, the volume stream. By means of the control device of the invention, the conventional arrangement is remarkably simplified since the maintenance intensive volume stream controllers are replaced by controllable throttle flaps. Thereby, the solution of the invention is less cost intensive and less maintenance intensive. Since a minimum pressure has to be provided for the functionality of a volume stream controller in its common arrangement, this has the disadvantageous result on the efficiency of such systems. An additional pressure has to be generated by the ventilator which pressure is not required for the air supply but only as a delimiting condition for the volume stream controller. By means of the advantageous embodiment of the invention, the room air managing system the requirement for pressure and, thereby, also the requirement for power to be generated therefore, is reduced while providing equal air supply.

The room air managing system is, in particular, embodied as an air conditioning system. This has the advantage that, besides the air pressure, also the climate conditions of the room can be adapted in a targeted way.

In a particularly advantageous embodiment, the exhaust air can be extracted through an exhaust air ventilator. This allows generation of a sub-pressure in the room. Furthermore, also a desired exhaust air quantity can be defined according to the requirements, for example in case of high contamination. In this case, the exhaust air ventilator is also controlled according to the desired exhaust air quantity.

In a further advantageous embodiment, an opening angle adjustable to a minimum is provided for the input air throttle flap. The opening angle is, therein, defined to a minimum adjustment whereby the opening angle is larger than the case of a closed throttle flap. The opening cross section is determined at a minimum input air ventilator speed. In this way, it is ensured that each room or each room zone is supplied with the required minimum of fresh air at any time.

In particular, the input air throttle flaps of the input air channel are adjustable in their maximum opening angle. Since the system relinquishes volume stream controllers, basically arbitrarily high volume streams can originate, for example in an air conditioning system with a large temperature difference. In order to avoid this, a maximum opening angle at maximum allowable input air ventilator speed is assigned to the respective input air throttle flaps in addition to their minimum opening angle at the occasion of starting the operation of the system. In this way, the maximum possible volume stream is delimited in an advantageous way. This provides the advantage of a comfortable room climate at a maximum speed of the air conditioning control since the volume stream cannot be over controlled.

It is, furthermore, advantageous to define the limits of the input air throttle flap position and the exhaust air throttle flap position in its maximum as well as minimum deviation in the sense of a hydraulic balance depending on the channel resistance. For example, at rising channel resistance the minimum opening angle of the input air throttle flaps which are closer to the input air ventilator are smaller than those distant ones depending on the distance of the throttle flap to the input air ventilator. The minimum limits of the opening cross sections are adjusted at minimum ventilator power. This is true for the exhaust throttle flaps in an analogous way.

According to this example, the maximum opening cross section of the remotely and/or disadvantageously positioned input air throttle flaps (with respect to the input air ventilator are larger than the maximum opening cross section of the closer and/or advantageously positioned input air throttle flaps (with respect to the input air ventilator). The maximum opening positions are determined at maximum ventilator power. In this way, the pressure losses across the channel resistance are taken into account and a constant air stream distribution is ensured in an advantageous way. By means of this optimizing operation, control can be achieved according to the required parameters with a minimum on volume stream. This again has an effect of cost reduction on the design and the operation of the system.

According to a further advantageous embodiment, a first climate controller is provided which cooperates with at least one input air throttle flap and the climate sensor. A desired value for the respective room is input into the first climate controller which it compares to the value of the climate sensor in the room and determines the opening cross section of the input air throttle flap accordingly. Thereby, the input air quantity is adjusted. This offers the advantage of an individual adjustment of the climate conditions for each individual room or each room zone.

Furthermore, a second climate controller may be provided which cooperates with all climate sensors out of all rooms and the input air ventilator. The controller defines on the basis of a method how the speed or the power of the input air ventilator is variably adjusted on the basis of the desired and actual values of the climate sensors in the respective rooms. This has the advantage that sufficient channel pressure is at hand in order to ensure control in the single rooms or room zones.

In a further advantageous embodiment, a first pressure controller is provided which cooperates with at least an exhaust throttle flap and a pressure sensor located in the room. Depending on a desired value desired for the room, the first pressure controller controls the exhaust air stream by means of predefining the opening cross section of the exhaust air flap. It is advantageous that, in this way, the exhaust air stream as well as the room pressure may be individually adjusted for each room.

Furthermore, the control device may comprise a third pressure controller which cooperates with the room pressure sensor and at least one input air throttle flap. This has the advantage that the input air stream may also be controlled depending on the pressure.

According to a further advantageous embodiment, a second pressure controller is provided which cooperates with the pressure sensors of all rooms or room zones and the exhaust air ventilator. The second controller defines, on the basis of a method, the power or speed of the exhaust ventilator. This is dependent from the value which is supplied by the room pressure sensors, as well as from the desired pressure values of all rooms and room zones. Therein, it is advantageous that the required exhaust air ventilator power is available in order to be able to control the rooms accordingly.

According to a further advantageous embodiment, a fourth pressure controller is provided which influences the input air ventilator. The values of the room pressure sensors as well as the desired pressure values are transmitted thereto. In case a desired room pressure is not possible because of the climate dependent control of the input air ventilator, the exhaust air throttle flaps and the exhaust air ventilators, additionally the input air ventilator is influenced by the fourth pressure controller. This is primarily necessary when the room climate is balanced and an over pressure is to be generated in the room at the same time. In this case, it is not sufficient that the exhaust air throttle flaps are completely closed and the input air throttle flaps are completely opened. Additional pressure has to be generated by the input air ventilator. In this arrangement, it is particularly advantageous that, in spite of a desired room climate, additionally an over pressure can be generated in the room which is applied to clean room applications, among others.

According to a further advantageous embodiment, the first and third pressure controller as well as the second and fourth pressure controller form a constructional unit.

A further embodiment has proven as particularly advantageous in which the above-mentioned controllers are part of a central computer unit of the system. The central computer unit and the above-mentioned controllers control the throttle flap positions and ventilator powers depending on all available parameters in an optimal way.

According to a further advantageous embodiment, the climate sensor comprises sensors for temperature and/or air moisture and/or oxygen content and/or other gases/contaminations. Therefore, the climate of a room can be adjusted on the basis of climate relevant parameters. Therein, a particularly comfortable room climate is an advantage.

As an alternative to this embodiment, the air quantity control can basically be realized instead of the pressure as a direct control variable based on the density as control variable. The density can, for example, be determined by means of density measurement instruments or by calculation out of the status variables of the room air.

Further advantages, features and potential applications of the present invention may be gathered from the description which follows, in conjunction with the embodiments illustrated in the drawings.

Throughout the description, the claims and the drawings, those terms and associated reference signs will be used as are notable from the enclosed list of reference signs. In the drawings:

FIG. 1 is a more or less schematic presentation of a control device indicated by the reference number for a room air managing system.

Figure 1:
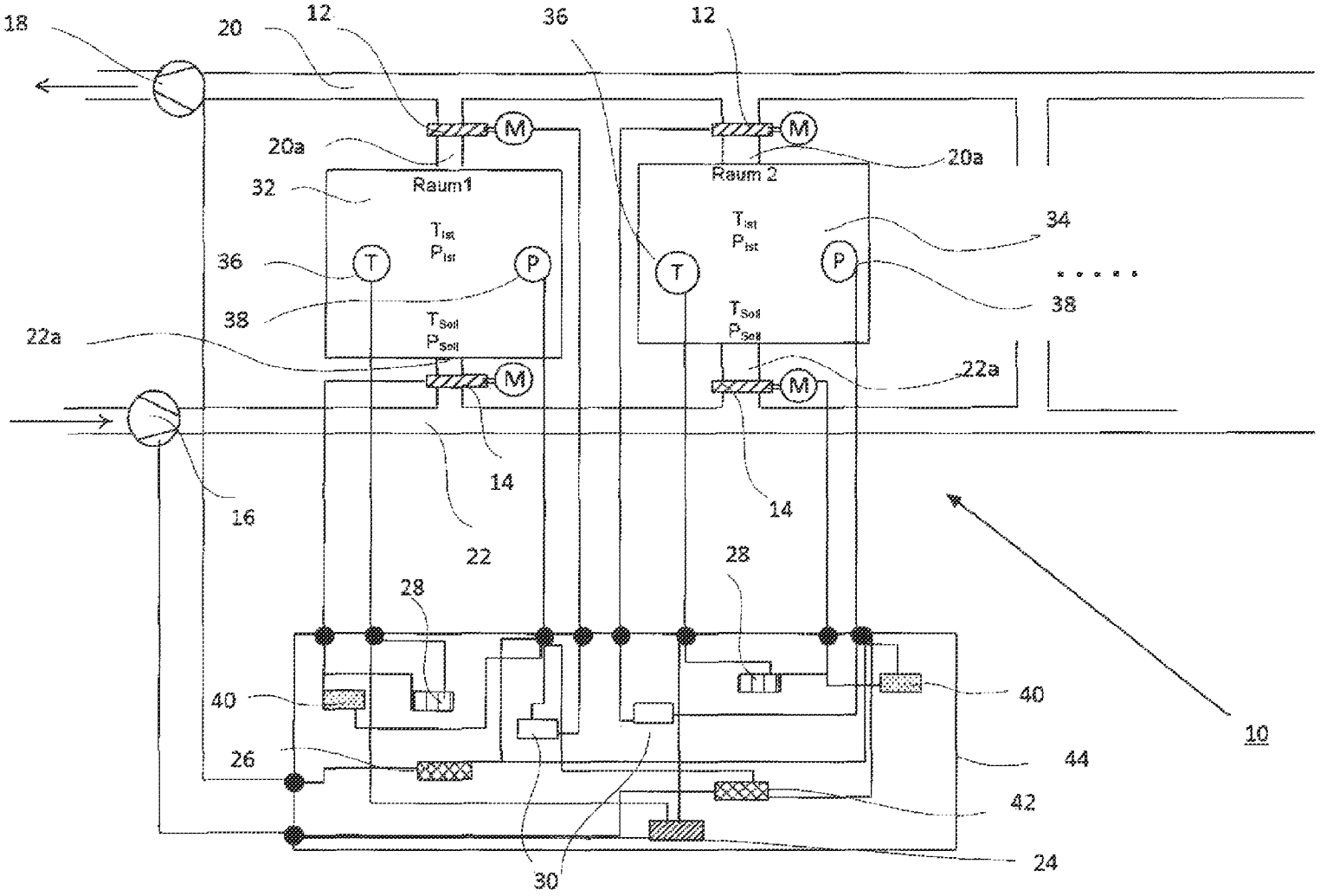
FIG. 1 is a schematic presentation of the control device with a temperature sensor.

As shown, the system comprises a central input air channel 22 as well as room input air channels 22*a* branching off there from. In an analogous way, the device comprises an exhaust air channel 20 and room exhaust air channels 20*a* branching therefrom. The input air ventilator 16 is positioned in the input air channel 22, the exhaust air ventilator 18 is located in the exhaust air channel 20. Furthermore, the rooms 32, 34 are shown which are to be air conditioned. The exhaust air throttle flaps 12 are located in the room exhaust air channels 20*a*, the input air throttle flaps 14 are in the room input air channels 22*a*. In the rooms 32, 34, there are the room pressure sensor 38 and the room climate sensor 36 which is formed, in this case, as a temperature sensor.

Climate sensor 36 is in operational connection with a first associated climate controller 28 which again is in operational connection with the input air throttle flap 14. A first pressure controller 30 is, additionally, shown schematically and is in operational connection with the associated room pressure sensor 38 and the exhaust air throttle flap 12. Furthermore, a second pressure controller 26 is provided which is connected to all room pressure sensors 38 in all rooms 32, 34 or room zones as well as with the exhaust air ventilator 18. Furthermore, a second climate controller 24 is shown which is connected to all room climate sensors 36 and the input air ventilator 16.

Furthermore, a third pressure controller 40 is provided which is connected with the respective input air throttle flap 14 and the corresponding room pressure sensor 38 as well as a fourth pressure controller 42 which is in operational connection with the input air ventilator 16 and the room pressure sensors 38.

As an example for the climate variable, an actual temperature Tactual and a desired temperature Tdesired is located in the rooms 32, 34. Furthermore, an actual pressure Pactual and a desired pressure Pdesired is allocated to the rooms 32, 34. The actual temperature Tactual is taken up by the climate sensor 36 located in the room 32, 34. This is a transmitted like a desired temperature Tdesired for the respective room 32, 34 as well as to the first climate controller 38 as well as to the second climate controller 24. The actual pressure Pactual present in the room 32, 34 is read out by the pressure sensor 38 and transmitted together the desired pressure Pdesired to the first pressure controller 30, the second pressure controller 26 as well as to the third pressure controller 40 and the fourth pressure controller 42.

Therein, the first climate controller 28 determines the opening cross section of the respective room input 30 air flap 14. The second climate controller 24 provides the respective control of the input air ventilator 16 depending on all Tactual and Tdesired which are transmitted to it. The input air ventilator 16 is controlled such that the required amount of air or the required air pressure are made available such that the climate of the room 32, 34 is optimally controlled with the greatest difference.

The first pressure controller 30 determines the opening angle of the exhaust air throttle flap 12 of the respective rooms 32, 34. The second pressure controller 26 determines the required speed of the exhaust ventilator 18 depending on the transmitted Pdesired and Pactual values of the individual rooms 32, 34.

The third pressure controller 40 controls the input air throttle flap position depending on the required pressure of the room. The fourth pressure controller 42 influences the power of the input ventilator 16 depending on the required pressure of all rooms 32, 34.

Figure 2:
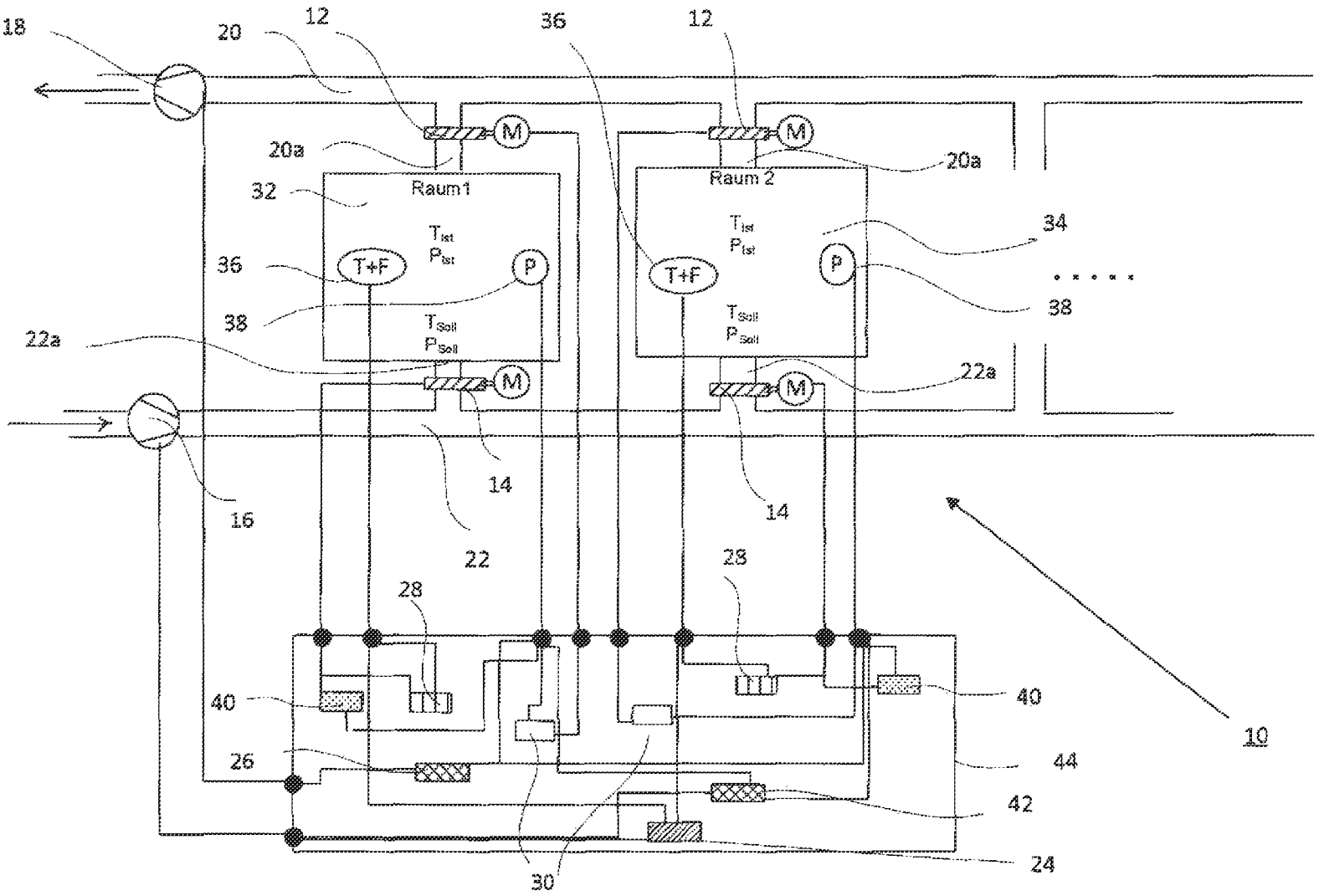
FIG. 2 is a schematic presentation of the control device with a temperature sensor and a moisture sensor.

FIG. 2 shows a more or less schematic presentation of a control device designated with the reference number 10 for an air conditioning system for air conditioning of rooms 32, 14.

As it is shown, the air conditioning system comprises a central input air channel 22 as well as room input air channels 22*a* branching off therefrom. In an analogous way, room exhaust air channels 20*a* are branching off from all rooms 32, 34 and lead into a central exhaust air channel 20. An input air ventilator 16 is provided in the central input air channel 22, and an exhaust ventilator 18 is provided in the central exhaust air channel 20. One exhaust air throttle flap 12 is located in the room exhaust air channel 20*a*, and an input air throttle flap 14 is in the room input air channel 22*a*. A room pressure sensor 38 and a room climate sensor 36 are mounted in the rooms 32, 34 wherein, in this embodiment, a room climate sensor 36 comprises a temperature sensor and a moisture sensor.

As an example, an actual temperature Tactual and a desired temperature Tdesired as well as an actual moisture Factual and a desired moisture Fdesired are each allocated to the rooms 32, 34 for a climate variable. Furthermore, an actual pressure Pactual and a desired pressure Pdesired are allocated to the rooms 25 32, 34. The actual temperature Tactual and the actual moisture Factual are read out by means of the climate sensor 36 located in the room 32, 34. These are transmitted like the desired temperature T desired and the desired moisture Fdesired for the respective room 32, 34 to a first climate controller 38 as well as to a second climate controller 24. For this purpose, one room climate sensor 36 is connected to the first, associated climate controller 28 which again is in operational connection to the input air throttle flap 14.

The first climate controller 28 determines the opening cross section of the respective room input air flap 14. The second climate controller 24 provides a corresponding control of the input ventilator 16 depending on all Tactual and Tdesired as well as Factual and Fdesired. The input ventilator 16 is controlled such that the required amount of air or the required air pressure is provided in order to provide an optimal control of the climate of each room 32, 34 which shows the largest difference of a climate variable, temperature or moisture. The temperature and moisture is than adjusted individually for each room by means of the input air throttle flaps 14 which are controlled by the first climate controller 28.

The actual pressure Pactual prevailing in a room 32, 34 is read out through the pressure sensor 38 and transmitted with the desired pressure Pdesired to all pressure controllers 30, 26, 40, 47.

A first pressure controller 30 is in operational connection with the related room pressure sensor 38 and the exhaust air throttle flap 12. A second pressure controller 26 is connected to all room pressure sensors 38 in all rooms 32, 34 or room zones as well as with the exhaust air ventilator 18.

The first pressure controller 30 controls the opening angle of the related exhaust air throttle flap 12 of each associated room 32, 34. A second pressure controller 26 determines the required speed of the exhaust ventilator 18 depending on the transmitted Pdesired and Pactual values of the individual rooms 32, 34.

A third pressure controller 40 is provided which is connected to the associated input air throttle flap 14 and the corresponding room pressure sensor 38. Furthermore, a fourth pressure controller 42 is provided which is in operational connection to the input air ventilator and all room pressure sensors 38.

The third pressure controller 40 controls the position of the input air throttle flaps 14 depending on the required pressure of the room. The fourth pressure controller 42 influences the power of the input air ventilator 16 depending on the required pressure of all rooms 32, 34.

Since the speed of the input air ventilator 16 is influenced by the second climate controller 24 as well as by the fourth pressure controller 42, always the largest required speed is set. Also the setting of the respective input air throttle flap is influenced by the first climate controller as well as the third pressure controller 40. Here, in case of differing requirements, the requirement of the climate controller has priority, and the pressure control is controlled through the exhaust air flap.

All controllers 24, 26, 28, 30, 40, 42 are part of a computer unit 44. This promotes short processing time periods and the compactness of the controller arrangement as well as their interaction.

In this way, the air management of a room 32, 34 which is influenced by differing control variables, is set. It is advantageous with this arrangement that the exhaust air stream can be controlled independent of the input air stream conditions. Therein, the control of the throttle flaps 12, 14 follow in direct dependency to the output signal of a room pressure sensor 38 mounted in the room 32, 34 which saves additional sensor means and control mechanisms. Therefore, a particular advantage is in the cost effectiveness of the control device 10.

LIST OF REFERENCE SIGNS

10 control device for a room air managing systems
12 exhaust air throttle flap
14 input air throttle flap
16 input air ventilator
18 exhaust air ventilator
20 exhaust air channel
20*a* room exhaust air channel
22 input air channel
22*a* room input air channel
24 second climate controller
26 second pressure controller
28 first climate controller
30 first pressure controller
32 room 1
34 room 2
36 room climate sensor
38 room climate sensor
40 third pressure controller
42 fourth pressure controller
44 computer unit

The invention claimed is:

1. Control device for room air managing systems, comprising at least:

a plurality of rooms (32, 34) or room zones; and interconnected with said plurality of rooms or room zones an inlet air channel (22) and room inlet air channels (22*a*) branching therefrom;

an exhaust air channel (20) and room exhaust air channels (20*a*) branching therefrom and interconnected with said plurality of rooms or room zones;

an inlet ventilator (16) in said inlet air channel (22);

controllable inlet air throttle flaps (14), said controllable inlet air throttle flaps (14) controlling inlet air flow in said room inlet air channels (22*a*) interconnected with said plurality of rooms or room zones;

controllable exhaust air throttle flaps (12), said controllable exhaust air throttle flaps (12) controlling exhaust air flow in said room exhaust air channels (20*a*) interconnected with said plurality of rooms or room zones;

a pressure sensor (38) in each of said plurality of rooms (32, 34) or room zones, said pressure sensor detects room pressure in said room (32, 34) or room zone that is to be air conditioned;

said room pressure is the direct control parameter for positioning said inlet air throttle flaps (14) and said exhaust air throttle flaps (12);

said position of said input air throttle flaps (14) is limited and said position of said exhaust air throttle flaps (12) is limited, and said limit of said input air throttle flaps and said limit of said exhaust air throttle flaps are set to hydraulically balance said rooms based on channel (20, 22) resistances; and, said inlet ventilator (16) is controlled such that the required amount of air or the required air pressure is available for climate control of said plurality of rooms (32, 34) or room zones with the greatest difference of a climate variable optimally controlled.

2. Control device according to claim 1, wherein said room air managing system is embodied as an air conditioning system, and, said rooms (32, 34) include room climate sensors (36).

3. Control device according to claim 1, further comprising: an exhaust air ventilator (18), said exhaust ventilator resides in said exhaust air channel (20).

4. Control device according to claim 3 wherein said exhaust air ventilator (18) is controlled depending on a desired exhaust air quantity.

5. Control device according to claim 4 wherein one of said input air throttle flaps (14) is set to a desired minimum through put position.

6. Control device according to claim 5 wherein one of said input air throttle flaps (14) is set to a desired maximum through put position.

7. Control device according to claim 2, further comprising a first climate controller (28) interacting with at least one associated input air throttle flap (14) and said respective room climate sensor (36).

8. Control device according to claim 7, further comprising a second climate controller (24) interacting with said input air ventilator (16) and said room climate sensors (36) of said plurality of rooms (32, 34).

9. Control device according to claim 8 further comprising a first pressure controller (30) interacting with at least one associated said exhaust air throttle flap (12) and said respective pressure sensor (38).

10. Control device according to claim 9, further comprising a second pressure controller (26) interacting with an exhaust air ventilator (18) and said room pressure sensors (38) in said plurality of rooms (32, 34).

11. Control device according to claim 10, further comprising a third pressure controller (40) interacting with at least one associated said input air throttle flap (14) and said room pressure sensor (36) in said plurality of rooms (32, 34).

12. Control device according to claim 11, further comprising a fourth pressure controller (42) interacting with said input air ventilator (16) and said room pressure sensors (38) in said plurality of rooms (32, 34).

13. Control device according to claim 12, wherein said second pressure controller (26) and said fourth pressure controller (42) form a constructional unit.

14. Control device according to claim 11, wherein said first pressure controller (30) and said third pressure controller (40) form a constructional unit.

15. Control device according to claim 14 wherein said room climate sensor (36) is embodied as a sensor for temperature, air moisture, or oxygen content.

16. Control device according to claim 15, wherein controllers (24, 26, 28, 30, 40, 42) are part of a common computer unit (44).

17. Control device according to claim 1, further comprising:

a sensor unit, said sensor unit determines gas density in said plurality of rooms (32, 34) to be air conditioned;

and, density is a direct control variable for positioning of one or more of said input air throttle flaps (14) and/or one or more of said exhaust air throttle flaps (12).

18. Control device according to claim 17, wherein said sensor unit measures a plurality of input values from which gas density may be calculated.

19. Control device according to claim 17, wherein said sensor unit comprises a gas density sensor which directly determines the gas density.

* * * * *

UNITED STATES PATENT AND TRADEMARK OFFICE

CERTIFICATE OF CORRECTION

PATENT NO. : 9,086,226 B2
APPLICATION NO. : 13/128227
DATED : July 21, 2015
INVENTOR(S) : Bauer It is certified that error appears in the above-identified patent and that said Letters Patent is hereby corrected as shown below:

In the Specification:

Col. 1, line 48, after "citation" delete ""AIIRFLOWCONTROL," and insert -- "AIRFLOWCONTROL, -- therefor.

Col. 6, line 35, after "moisture is" delete "than" and insert -- then -- therefor.

Col. 6, line 41, after "40," delete "47." and insert -- 42. -- therefor.

In the Claims:

Claim 1, Col. 7, line 45, after "room zones" delete "and interconnected with said plurality of rooms or room zones".

Claim 1, Col. 7, line 48, after "branching therefrom" insert -- and interconnected with said plurality of rooms or room zones --.

Signed and Sealed this
Eighth Day of March, 2016

Michelle K. Lee

Michelle K. Lee
*Director of the United States Patent and Trademark Office*